US010694904B2

(12) United States Patent
Gordon

(10) Patent No.: US 10,694,904 B2
(45) Date of Patent: Jun. 30, 2020

(54) CONTAINER OF WIPES WITH A 'FALLBACK PREVENT' DISPENSING NOZZLE

(71) Applicant: Michael John Gordon, London (GB)

(72) Inventor: Michael John Gordon, London (GB)

( * ) Notice: Subject to any disclaimer, the term of this patent is extended or adjusted under 35 U.S.C. 154(b) by 0 days.

(21) Appl. No.: 16/213,531

(22) Filed: Dec. 7, 2018

(65) Prior Publication Data

US 2020/0121139 A1 Apr. 23, 2020

Related U.S. Application Data

(63) Continuation of application No. PCT/IB2016/053471, filed on Jun. 13, 2016.

(51) Int. Cl.

| | |
|---|---|
| ***A47K 10/44*** | (2006.01) |
| ***B65D 83/08*** | (2006.01) |
| *A47K 10/32* | (2006.01) |

(52) U.S. Cl.

CPC ..... *A47K 10/44* (2013.01); *B65D 83/0835* (2013.01); *A47K 2010/3233* (2013.01); *A47K 2010/3266* (2013.01)

(58) Field of Classification Search

CPC ..... A47K 10/3818; A47K 2010/3206; A47K 2010/3233; A47K 2010/3246; Y10T 225/393

USPC ..... 221/33–63

See application file for complete search history.

(56) References Cited

U.S. PATENT DOCUMENTS

| | | | | |
|---|---|---|---|---|
| 3,749,296 | A * | 7/1973 | Harrison | A47K 10/3809 225/106 |
| 3,868,052 | A * | 2/1975 | Rockefeller | A47K 10/3809 225/106 |
| 6,145,782 | A * | 11/2000 | King | A47K 10/3818 242/593 |
| 6,554,156 | B1 * | 4/2003 | Chong | A47K 10/3818 221/303 |
| 8,857,614 | B2 * | 10/2014 | Gordon | B65D 83/0805 206/233 |
| 2005/0029280 | A1 * | 2/2005 | Hayes | B65D 1/04 221/34 |
| 2010/0133287 | A1 * | 6/2010 | Tramontina | A47K 10/3818 221/45 |
| 2010/0264159 | A1 * | 10/2010 | Gordon | A47K 10/16 221/46 |

(Continued)

*Primary Examiner* — Gene O Crawford
*Assistant Examiner* — Ayodeji T Ojofeitimi

(57) ABSTRACT

The invention relates to a dispensing nozzle 2 for a container of wipes (not shown). The nozzle 2 features an annular projection 14 the inside of which features inward facing spikes 17. The spikes can be made from a flexible elastomer or a non flexible polypropylene material. The spikes 17 feature 'slit' sections of weakness that enables the spikes to flex upwardly when subjected to upward pressures from say a wipe (not shown) passing though the structure of the dispensing nozzle 2.

Figure 1:
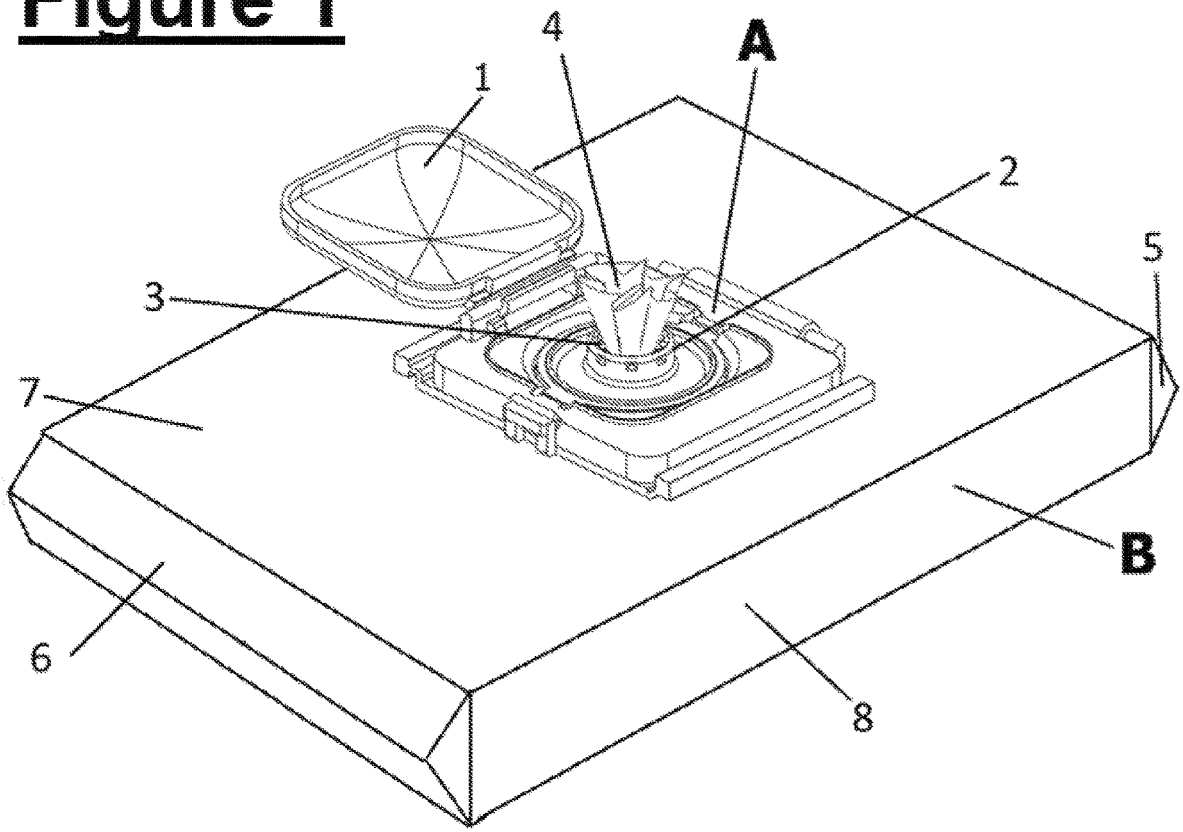

If downward forces act on the wipe after it has been inserted into the nozzle so as to force the wipe 4 back into its container, two things happen.

1) The spikes 17 or spikes flex back to their original position thereby imposing space restrictions within the annular projection that imped wipe fall back.
2) The ends 20 of the spikes 17 dig into the wipe thereby impeding wipe fall back still further.

26 Claims, 7 Drawing Sheets

(56) References Cited

U.S. PATENT DOCUMENTS

| | | | | |
|---|---|---|---|---|
| 2013/0306669 | A1* | 11/2013 | Ray | A47K 10/24 221/63 |
| 2014/0291439 | A1* | 10/2014 | Winestock | A47K 10/3827 242/588.3 |
| 2014/0367400 | A1* | 12/2014 | Crudge | A47K 10/3818 221/1 |
| 2015/0048105 | A1* | 2/2015 | Gordon | A47K 10/421 221/63 |
| 2015/0048135 | A1* | 2/2015 | Bredahl | A47K 10/3818 225/42 |
| 2015/0053812 | A1* | 2/2015 | Bredahl | C08G 18/283 242/588.3 |
| 2016/0000276 | A1* | 1/2016 | Rozek | A47K 10/3818 242/593 |

* cited by examiner

CONTAINER OF WIPES WITH A 'FALLBACK PREVENT' DISPENSING NOZZLE

BACKGROUND OF THE INVENTION

The present invention relates to a container of wipes with a 'Fallback Prevent' dispensing nozzle.

It is well known to house wipes in containers and such containers are typically of two different varieties. The first type is a cylindrical housing made of relatively solid polypropylene material with a sealed end and an open end. An end cap is typically provided for the open end which features an aperture through which wipes are dispensed. The aperture is usually located in a recess in the end cap, and a sealing cap is generally provided which then seals the container.

The second type of container is generally that of the soft pack variety which are comprised of a flexible material like polyethylene, hermetically sealed at opposite ends and featuring a die-cut opening on its uppermost surface through which wipes are extracted from the pack.

Wipes are produced in various formats. Firstly they can be in the form of elongate continuous sheets of moistened or impregnated material with spaced lines of perforations dividing one sheet of material into hand-sized wipes or towelettes. The perforated sheet material is then generally in the form of rolls when stored within cylindrical containers, and wipes are generally extracted from the central core of the roll when pulled through the aperture of the container. When stored in hermetically sealed soft packs, the perforated sheet material is generally folded into stacks and wipes are generally extracted from the top of the stack and pulled through the die-cut opening on the upper side of the hermetically sealed container. These folded stacks of perforated sheet material can also be stored in specially designed hard plastic containers featuring a hinged lid with an aperture built into it through which wipes are extracted from the container. As to both types of containers, in use when a wipe is withdrawn through the aperture or die cut opening, the narrowness of the aperture or die cut opening causes the material to rupture along the line of perforations between the wipe sheets, a single wipe is then released from the sheet of material, with the intention of leaving a tail of the next wipe projecting through the cap aperture for the next user to grasp.

Secondly wipes can be manufactured into individually cut sheets of moistened or impregnated material which are then generally stored within hermetically sealed containers in an interleaved folded format. Wipes are then extracted through the die cut opening of the soft pack from the top of the stack. Again, these interleaved, folded stacks of cut sheets can also be stored in specially designed hard plastic containers featuring a hinged lid with an aperture built into it through which wipes are extracted from the container. As the top wipe is extracted, the forces of viscosity between the end of the top wipe and the beginning of the trailing wipe is enough to pull the trailing wipe towards the die cut opening or aperture. The narrowness of the die cut opening or aperture then causes the first wipe to separate from the trailing wipe with the intention of leaving sufficient tail of the trailing wipe projecting through the opening for the next user to grasp.

The viscosity between the ends of the cut sheets can be purely a direct result of the liquid impregnate or can be enhanced by means of a mild adhesive applied to the ends of the cut sheets.

Thirdly wipes can be manufactured which are in the form of a discrete length of continuous sheets of moistened or impregnated material with spaced lines of perforations dividing one sheet of material into hand-sized sheets. Each of the ends of the discrete lengths are then connected together by way of a mild adhesive. The same principles as to extraction and wipe separation would apply as described concerning all of the wipe types mentioned above.

PRIOR ART

An example of a container is described in German Offenlegungschrift DE-A1-40 06 987 (Penaten). The dispenser has an orifice through which sheets of material are pulled. Mention is made of the applications of such sheets or tissues and the various mixtures and types of liquid with which they may be impregnated.

There are three main problems associated with such containers. Often when a wipe is withdrawn from the container, the bond between the wipes, in this case the line of perforations, ruptures before the wipe is fully withdrawn through the cap aperture. The tail of the next wipe will be of a generally cylindrical shape, tapered at both ends. The rupturing of the perforations to cause separation of the wipes will generally take place at the point where the diameter of the cylindrically shaped emerging tail is such that becomes fixed within the opening of the aperture, the wipes then separate and tail of the emerging wipe presents itself for the next user to grasp. However if the perforations rupture prematurely, it is highly likely that the exiting wipe will separate from the adjacent wipe before the point at which the diameter of the emerging wipe is wide enough for the tail to become entrapped within the diameter. If this happens, the tail of the emerging wipe will then slip back into the container. The user then needs to remove the cap and feed the fallen tail of the next wipe to be dispensed through the cap aperture.

Another problem being that the aperture or opening of the container fails to exact enough pressure as the wipes are extracted to cause the bond between the ends of the wipes to rupture. The wipes will then fail to separate into individual sheets resulting in a 'stream' of wipes being inadvertently extracted when only one was required.

A further problem was that wipes, which were intended to be moist, but if the container of wipes is stored and not used for a length of time, the wipes dry out due to wicking and because vapour can emerge from the container through the cap aperture or die cut opening.

International Patent Application Number WO-A1-2006/124429 (BKI Holding Corp) to some extent solved the third problem and provides a container for wipes having a centre pull feed arrangement for dispensing sheets, typically off a roll. The dispenser includes a tray that supports a web roll which removes excess moisture form a sheet that is being dispensed and returns moisture, by way of a wicking action, to the remaining sheets within the container.

Another dispenser is described in U.S. Pat. No. 5,246,137 (James River Paper Company) discloses a device for dispensing individual sheets from a roll wherein the dispenser is in the form of a nozzle. However, it is not apparent how successful this device is at retaining moisture within the container, thereby ensuring that wipes, when dispensed are sufficiently wet.

U.S. Pat. No. 6,328,252 (Georgia Pacific France) discloses a dispenser for wipes which are intended to unwind from the centre of a roll. The container includes a nozzle that has a generally frusto-conical shape that is shaped and oriented to ease the introduction of the free end of a roll of wipes into and through the orifice. The dispenser shown is relatively complex and comprises a significant number of discrete and relatively complex moulded items. Additionally, it is not apparent how successful or practical it would be to apply this technology to a loose container.

Another container is described in U.S. Pat. No. 6,186,374 (Seaquist Closures Foreign Inc), which discloses a container for dispensing wipes with a structure extending from the body of the container which defines a dispensing surface for directing a stream of wipes from the roll (housed within the container) to a nozzle region from where a single wipe may be torn.

The container has a lid which defines a passage through the lid. A flexible valve is provided through which wipes pass. The flexible valve has self sealing slits which flex in order to permit the passage of towels. However, there still remains the problem, when withdrawing wipes from the container, that either perforations rupture before the wipe is fully withdrawn or lines of perforations separating the wipes fail to rupture, resulting in a 'stream' of wipes being dispensed.

It is thus apparent that two conflicting requirements are present relating to how tight the wipes are gripped as they exit the container. On the one hand it is essential that the container remains as close to an hermetically sealed environment as possible, so as to ensure the wipes retain moisture; whereas on the other hand, too tight a grip on the wipes as they are being withdrawn, imparted by the dispensing orifice, either gives rise to unpredictable or premature tearing of the wipes.

Additionally, there must be a mechanism that allows free passage of the wipes to exit the container, one that exerts enough pressures to ensure that the wipes separate into single sheets leaving a tail for the next user to grasp, this same mechanism being able to actively prevent the tail of the wipe from slipping back into the container.

It may also be advantageous to build in a safety feature. In the event that a wipe gets stuck in the aperture it is often a tendency for the user to try to push the offending wipe back into the container. In so doing the user may be pushing against the flaps or spikes that may be deployed within the opening of the container in an effort to push back the offending blocked wipes. The ends of said flaps or spikes will then generally be pushed in a direction opposite to the passage of the wipe out through the container so as to widen the opening in order for the trapped wipe to be released. But the user then runs the risk of entrapping their fingers in the now widened opening. If the users finger then penetrates beyond the ends of the flaps or spikes, it becomes very difficult to release the finger. This could then result in considerable discomfort and maybe even injury to the user especially if the ends of the flaps or spikes are sharply pointed. If a small child picks up the container, out of curiosity the child may also push their fingers down into the opening with similar very painful consequences.

It is advantageous therefore to minimise the possibility for the user or for children to entrap fingers by pushing them down into the aperture.

The invention overcomes the aforementioned problems and provides an improved dispenser which is cheap to fabricate and which is easy and reliable to operate.

BRIEF SUMMARY OF THE INVENTION

According to a first aspect of the invention there is provided a dispensing container for wipes with a dispensing nozzle comprising:

1) A dispensing container for wipes, said wipes being releasably attached to each other in a series which are capable of being detached into separate wipes when subject to a separation force. The dispensing container has a dispensing nozzle. In use a wipe can be withdrawn from the dispensing container through the dispensing nozzle which exerts sufficient gripping force on the wipe so as to apply a force of sufficient magnitude as to enable or promote the separation of one wipe from its adjacent wipe.

2) One or more spikes or projections are deployed within the dispensing nozzle, one or more spikes or projections being able to flex between a first position, that of the one or more spikes or projections being generally pointing at least towards the centre of the aperture and a second position, the ends of one or more spikes or projections being generally at an angle inclined in the direction to the passage of the wipe as it is withdrawn from the dispensing container through the dispensing nozzle, its bending moment being such that it requires less force to flex the one or more spikes or projections from their first position to their second position than it takes to flex the one or more spikes or projections from their first position to their third position wherein the ends of the spikes or projections are generally at an angle inclined in the direction opposite to the passage of the wipe as it is withdrawn from the dispensing container.

3) One or more spikes or projections feature areas of weakness to enable them to flex between a first position, and their second position.

When a wipe is inserted into and as a wipe passes through the dispensing nozzle and out of the container, the spikes or projections flex about their point of weakness, their axes, to a forward facing angle to the passage of the wipe, their second position. The width of the opening formed at the tips of the spikes thereby increases allowing free passage of the wipe through the dispensing nozzle.

However, when downward forces are exerted on the wipe, the forward facing spikes or projections, which are essentially in a barbed position, dig into the wipe thereby impeding its fall back into the container. The action of the spikes or projections returning back towards their first positions reduces size of the opening between the tips of the spikes or projections, which thereby further impedes its fall.

So fall back is impeded by two factors:

The barbed ends of these projections digging into the falling wipe.

The width of the opening becoming reduced as the spikes return towards their first position.

A similar result could be obtained from spikes or flaps featuring a tapered lower surface and made from a flexible material. In such a situation the projections would flex in the direction of passage of the wipe through the nozzle and the ends of the projections would pinch the wipe to prevent its fall back into the container. But they would flex in a sort of arc shape, gradually flexing more as the spike gradually thinned to its tapered end and the thinner ends of the projections would be weaker than any other part of the structure of the projection, perhaps too weak to prevent wipe fall back for heavier substrates.

Additionally it may be advantageous to have the projections in a sort of one-way valve format in order to prevent users or curious small children from being able to push their fingers into the lid of the container, which could be injurious to them.

The invention overcomes the aforementioned problems by featuring projections that have a specific line/section of weakness about which the spikes flex rather than projections that gradually flex/arc across all of its length. The benefits being:

1) The projections can be stronger, more rigid throughout their structure making them more appropriate perhaps for heavier substrates or to counter higher downward forces etc.

2) It makes it easier, less iterative to design the dispensing nozzles because the depth of flex is a very specific variable to adjust that can yield predicable results. Adjusting the whole tapered shape would be much more complicated.

Additionally if the indent/area of weakness is applied only to the underside of the projection then the projections will only flex in one direction therefore providing for the one-way valve facility that could help to prevent injury.

Preferably therefore the spikes or projections may feature a hinge like point, area, line or section of weakness/flexure on their structure which acts as a sort of axis, creating a bending moment which causes all or part of the structure of the spikes or projections between said point of weakness/flexure and the centre of annular projection to flex and thereby point generally inwardly and at an angle to the direction of the passage of the wipe when it passes through the aperture and out of the container.

Preferably the hinge like point, area, line or section of weakness/flexure is in the form of a linear indent, series of indents, line or series of holes or any other means by which a section of a spike or projection is weakened to enable all or part of the structure of the spikes or projections to flex.

Preferably the hinge like area of weakness/flexure of a spike or projections is caused by both the shape/angularity/tapering of the spikes of projections in addition to the indent areas of weakness.

Preferably the hinge like area of weakness/flexure of a spike or projections is only featured on the lower side of the base of the spike.

Preferably therefore the indent configuration on the spikes results in the bending moment of the one or more spikes being such that it requires less force to flex the spikes or projections from their first position to their second position than it takes to flex the spikes or projections from their first position to their third position wherein the ends of the spikes or projections are at an angle in the general direction opposite to the passage of the wipe as it is withdrawn from the dispensing container.

Preferably the dispensing nozzle is fixed to the upper surface of the dispensing container.

Preferably the dispensing nozzle features and annular projection firmly attached to a widened base.

Preferably the widened base is dome shaped.

Preferably the dispensing nozzle can be formed from a flexible, elastomeric material.

Preferably the dispensing nozzle could be formed from a less flexible polypropylene type material.

Preferably the dispensing nozzle could be formed from a combination of both flexible elastomeric and less flexible materials.

Preferably the nozzle exerts a gripping force on the tail of the emerging wipe and is shaped such that it prevents release of moisture from the inside of the container and to help prevent wicking of moisture from a wipe tail.

Preferably the nozzle is dimensioned such that any force pulling the wipe back into the container, biases the nozzle into a contracted state.

Preferably the nozzle may feature just spikes or projections on its inner surface of the annular projection.

Preferably the nozzle may feature a combination of spikes or projections on its inner surface of the annular projection together with ribs, pips, spikes, projections, raised or roughened region or other gripping means together.

Preferably the ribs, pips, spikes, projections or any other raised or roughened region are formed integrally with the nozzle and ideally in a single shot injection moulding process.

Preferably the ribs, pips, spikes, projections or gripping means or any other raised or roughened region may be formed in a pattern which is circularly symmetric or radially symmetric around the inner surface of the nozzle.

Preferably the ribs, pips, spikes, projections or any other raised or roughened region may be disposed in the form of a continuous spiral or at intervals so as to optimise grip.

Preferably the nozzle may be teat-shaped, or cone shaped and taper from a widened base to a tip, and an opening provided at the tip.

Preferably the nozzle may be in the form of an annular projection with parallel sides and a tip, and an opening provided at the tip.

Preferably the wall of the dispensing nozzle tapers in an inward direction from a widened base, and then curves outwards into an annular projection, the annular projection defining an opening provided at the top of the walls of the annular projection.

Preferably the dispensing nozzle features a widened base dome shape which curves outwards to form the annular projection to make it easier for the user to feed the first wipe into the dispensing nozzle and for wipes to be pulled from the top of a stack of wipes and enter the annular projection more gracefully.

Preferably the nozzle projects beyond the outer surface of the container.

Preferably the spikes or projections, when in their first position, may form a valve-like structure that seals the container prior to the insertion of a wipe.

Preferably the spikes are of an even width throughout their structure.

Preferably the spikes are thicker towards their base and come to a fine point at their tip.

DETAILED DESCRIPTION OF THE INVENTION

Embodiments of the invention will now be described with reference to the accompanying drawings in which:

Referring to FIG. 1 there is shown a top view of a Rigid Flip Top (RFT) A attached to a hermetically sealed soft pack dispensing container of wipes B. The soft pack is generally cuboid, having two similar rectangular sides (only one side 8 being here visible), two ends 5, 6, and an upper face 7, and lower face 8 (not shown). The soft pack contains a stack of wipes (not shown) encapsulated by an outer covering of flexible, impermeable material, typically formed from a sleeve of material bonded at each of the ends 5, 6, so that the soft pack is hermetically sealed, apart from the opening through the RFT A.

The soft pack has an RFT A bonded to the upper face 7.

The RFT A features a central dispensing nozzle 2 covering the aperture (not shown) of the soft pack of the lid C container. The central nozzle 2 is shown with the tail of a wipe 4 protruding through its opening 3. The opening 3 may be sealed using a sealing cap 1 here shown in open position.

Referring to FIG. 2 there is shown cross section views of stacks of wipes 3 within a container B. The container B (which conveniently is shown to be of cuboid shape), can be made from a soft flexible material or a less flexible polypropylene material.

Figure 2A:
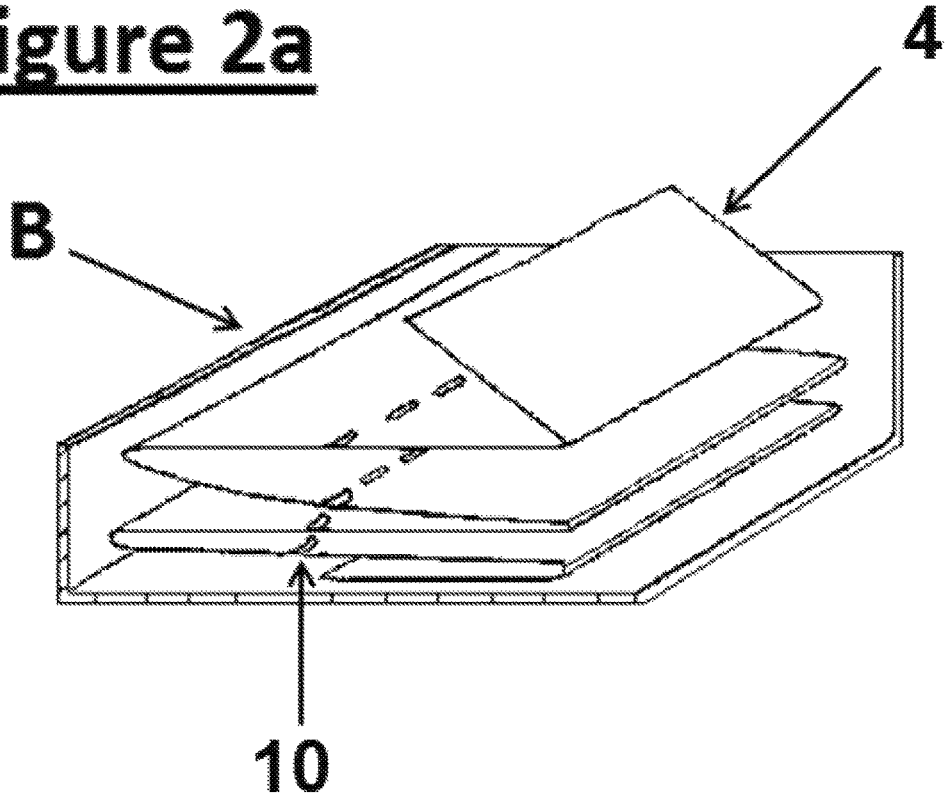

The wipes 4 shown in FIG. 2*a* are in a folded format. The individual wipes are here shown separated by lines of perforations 10. However the length of wipe material that is shown in the stack could feature some other method by which the sheets are bonded together along all or part of its length, like a mild adhesive or bonded together due to the viscosity of liquid that impregnates the wipe material, or due to the friction between the interleaved sheets. The stack of wipes 4 could perhaps feature a combination of mild adhesive, lines of perforations or liquid impregnate viscosity or interleaved formation bonding the individual sheets together.

Figure 2B:
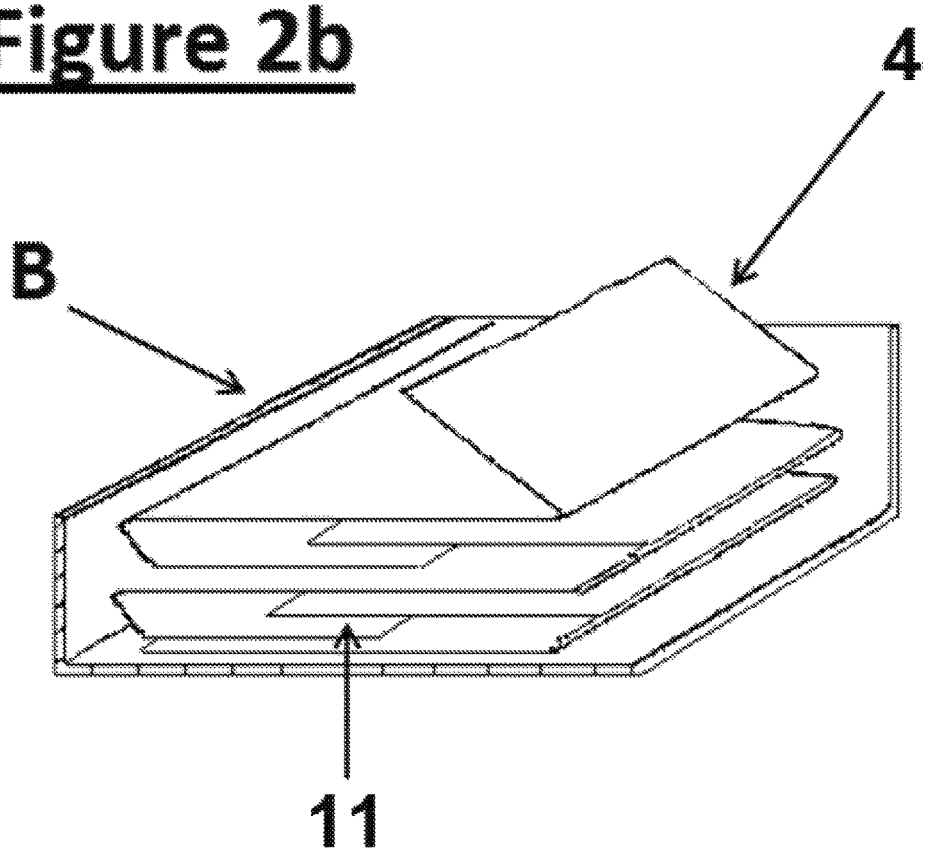

The wipes 4 shown in FIG. 2*b* are in a folded, interleaved format 11, the back end of each individual wipe is interleaved with the front end of the trailing wipe. The interleave can be in the form of 'C' fold, 'Z' fold 'Quarter' fold or any other folded format as well known to those skilled in the art. As the top wipe is extracted from the container, the frictional action of the interleave connection between the wipes is enough to pull the trailing wipe towards the opening (not shown) of the container B. If the wipes are impregnated with a liquid, forces of viscosity between the ends of the wipes would further enhance the bond between them as would the addition of a mild adhesive applied to the ends of each individual wipe. The stack of wipes 4 could perhaps feature any combination of mild adhesive, lines of perforations or interleave connection bonding the individual sheets together.

Figure 3:
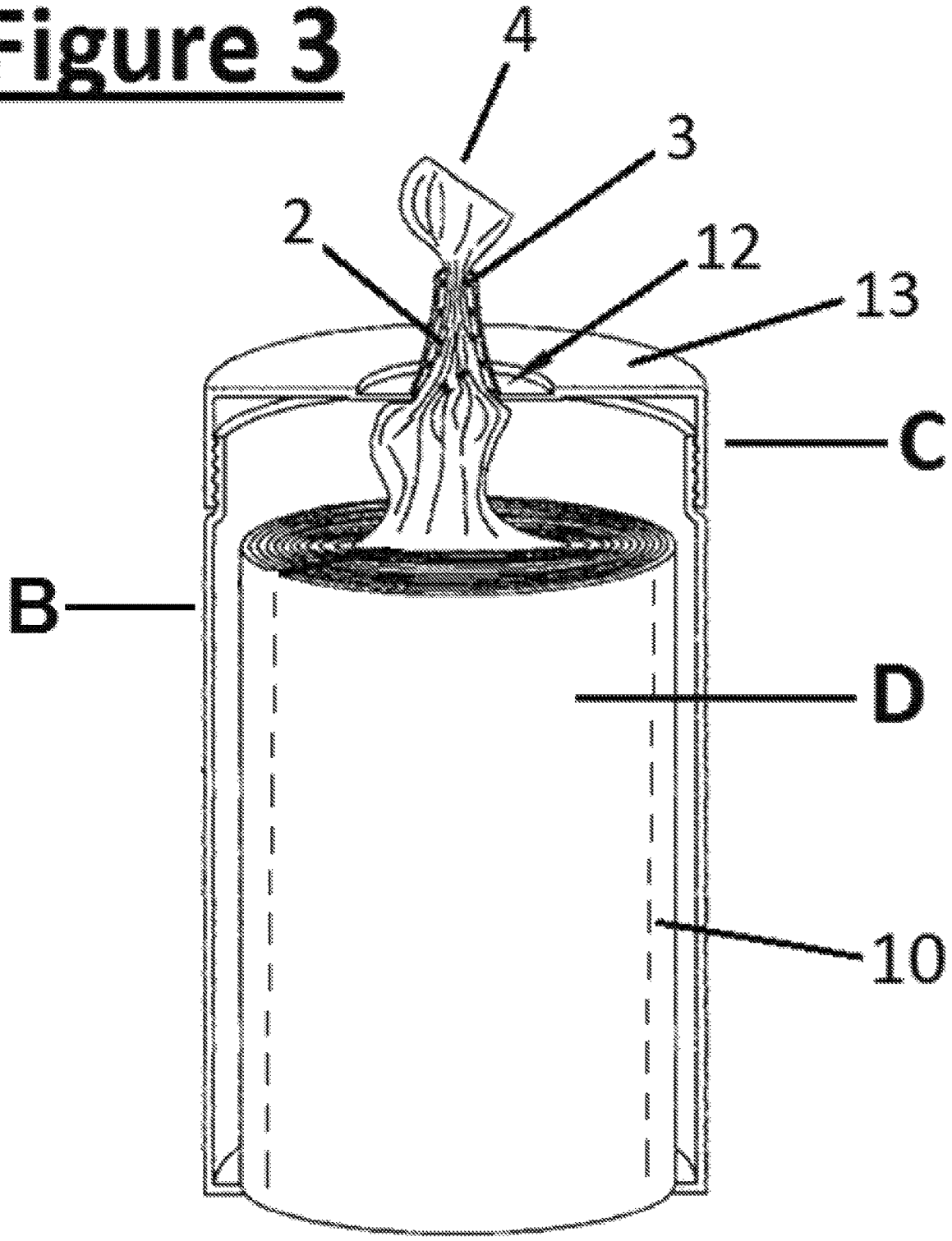

Referring to FIG. 3 there is shown a cross section view of a container of wipes which is in the form of a cylindrical canister B featuring a removable cap C and contains a roll of wipes D.

The lid C has a central dispensing nozzle 2 which covers the opening of the lid C on the upper face 13. The nozzle 2 is shown with the tail of a wipe 4 protruding through its opening 3. The aperture may be sealed using a sealing cap (not shown). The nozzle 2 can be made from a flexible elastomeric material or a less flexible material like polypropylene. The roll of wipes D will typically feature lines of perforations 10 separating the roll into single sheets, and the wipe material will feed through the opening of the container 12 then through the nozzle 2 from the central core of the roll D. However the roll of wipes D could feature some other method by which the sheets are bonded together along all or part of its length, like a mild adhesive. The roll of wipes D could perhaps feature a combination of mild adhesive and lines of perforations bonding the individual sheets together.

The canister B and lid C could be in the form of a more rigid housing, one that is either portable or alternatively fixed to a horizontal or vertical surface.

The dispensing nozzle 2 may be in a form such that it can be retro-fitted to the lid C or permanently bonded to it by way of a single or two shot mold process.

Referring to FIG. 4 there are shown two cross section views of a dispensing nozzle 2. The nozzle 2 is shown to feature an annular projection 14 attached to a dome shaped structure 15. The nozzle 2 could be fixed within a Rigid Flip Top (not shown) which itself would be fixed over the opening to a soft pack container like that shown in FIG. 1 or the lid of a canister of wipes like that shown in FIG. 3. The inside wall of the annular projection 14 features protuberances 16 and spikes 17. The spikes 17 feature a one-way hinge like point of weakness axis 18 resultant from a 'slit' 19 in the structure of the spike 17 which extends to the axis of the spike 18.

Figure 4A:
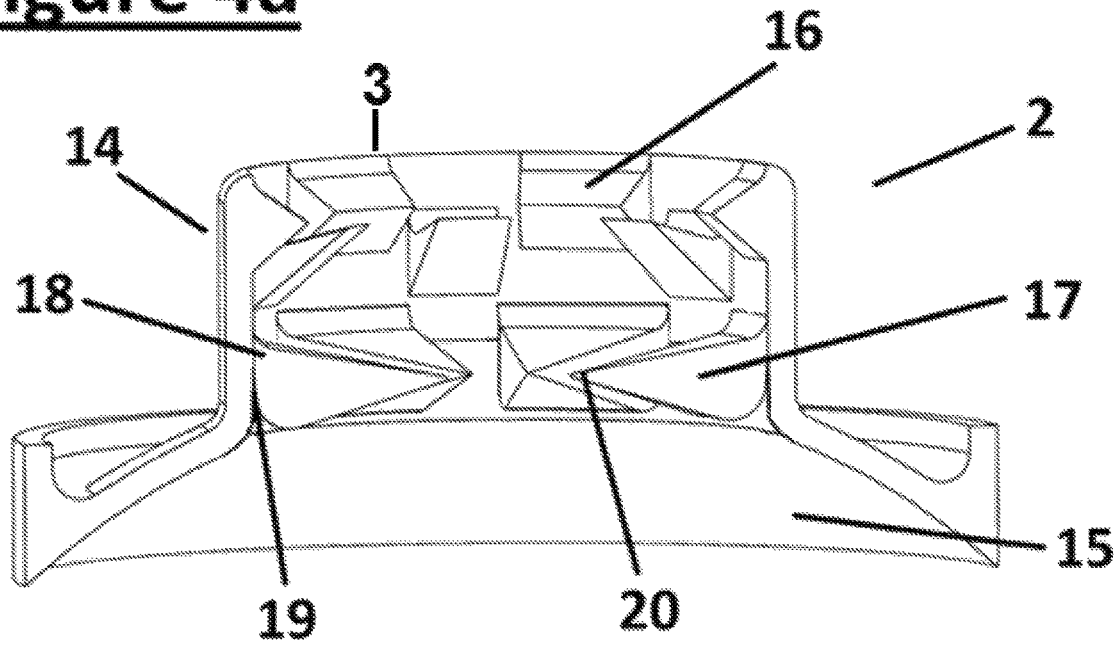

FIG. 4*a* shows an upward facing dispensing nozzle 2 with a relatively wide base 15 which tapers radially inwards and then smoothly curves upwards into the annular projection 14 which terminates at the tip to provide an opening 3 for the wipes' exit.

The widened dome shaped base enables easy feed of the first wipe. It also facilitates graceful passage of the wipes into the annular projection.

This is because as a wipe is extracted from the top of a stack of wipes, the outsides of the wipe near the perimeter of the container are pulled towards the centre of the stack and form a conical shape prior to exiting the container through the narrow annular projection. The nozzle having a widened base which curves outwards into an annular projection enables the sections of the wipe on the outside sections of the stack to enter the restrictive, narrow annular projection more gradually, more smoothly, more gracefully. This thereby reduces the possible incidence for the wipe to separate prematurely. Should the wipe enter the annular projection from a more acute angle, the corner, at which the base of the annular projection is formed, could exert pressures on the moving wipe that result in premature separations of the wipes.

However a consequence of a dome structure is that the space between the outset of the annular projection and top of the stack of wipes is thereby increased, which could provide greater opportunity for the wipe to fall back into the container. The barbed action of the spikes or projections and their return to position 1 if the wipe is subjected to downward forces impedes the wipe from falling back. The combination of the widened dome shape together with the annular projection featuring the spikes thereby enables the user to gain the advantages of easier feed of the first wipe and smoother passage of the wipe from the container without increased risk of the wipe falling back into it.

The spikes 17 and protuberances 16 deployed on the inside walls of the annular projection 14 are there to help bring about rupturing of the bonds between the wipes (not shown), e.g. their perforations, to enable the web to separate into single sheets. The underside of the spikes 17 is of a smooth curved shape to aid the passage of the wipe up through the annular projection 14 and prevent premature rupturing of the bonds between the wipes. The spikes are generally pointing inwards towards the centre of the annular projection 14, their first position.

Figure 4B:
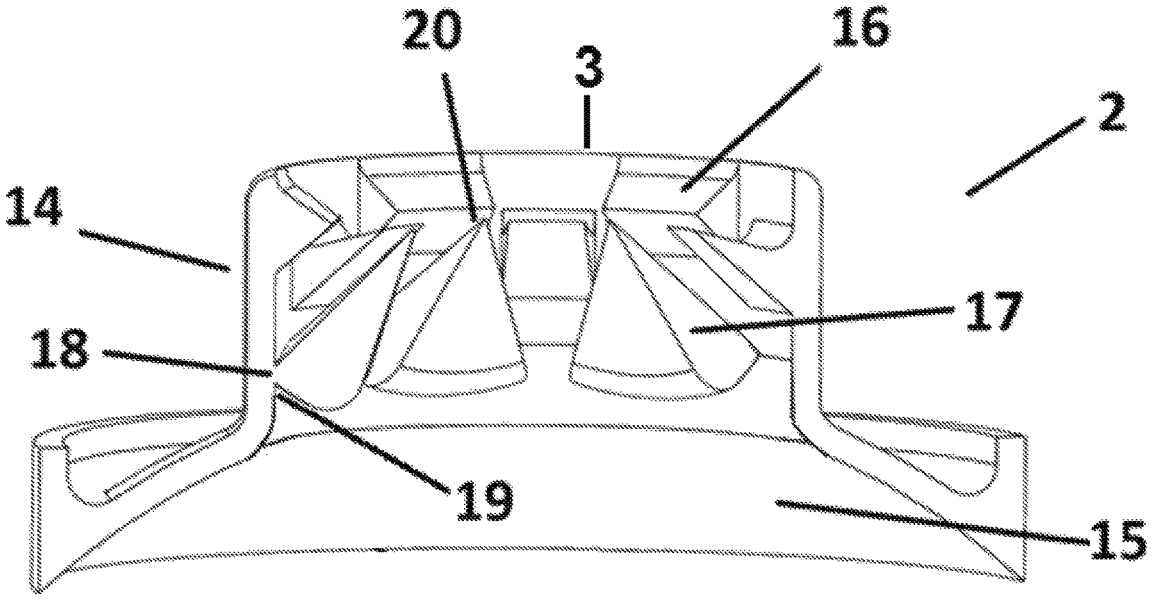

FIG. 4*b* shows the spikes 17 in their second position, here shown as being at an upward/centrally facing angle having been subjected to upward pressures due to say, a wipe being withdrawn from the container through the annular projection 14. The axis 18 is on the upper section of the spike 17, therefore the spike 17 can freely move upwards as upward pressure is applied to it.

However greater force would be required to move it from its first position to its third position wherein the ends of the spikes are at an angle in the general direction opposite to the passage of the wipe as it is withdrawn from the housing container. This is because, as can be seen in FIGS. 4*a* & 4*b*, if the spikes are subjected to downward forces, the bases of the spikes 17 would abut the inside wall of the annular projection 14.

Should a wipe (not shown) that has entered the annular projection 14 be subject to any downward pressures that could force the wipe to slip downwards into the container, the pointed ends 20 of the spikes 17, which are in their second position, would impact and dig into the falling wipe as the spikes 17 return towards their first positions. The return of the spikes 17 towards their first positions then reduces the size of the gap between the ends of the spikes 20 which therefore further curtails the fall of the wipe.

The shape of the annular projection 14 is here shown to have parallel sides however it could be teat-like or conical or any regular or irregular shaped annular projection.

FIG. 5 shows various perspectives of a variation of the nozzle shown in FIG. 4, one that features spikes 17 without additional protuberances 16.

Figure 5A:
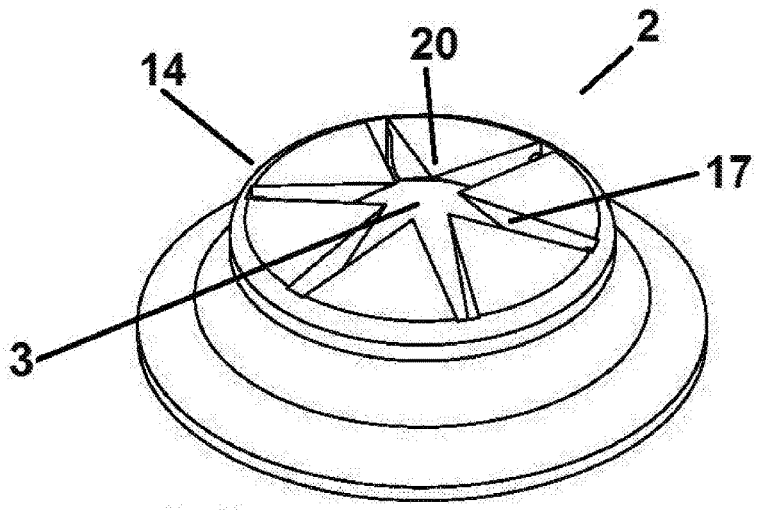
Figure 5B:
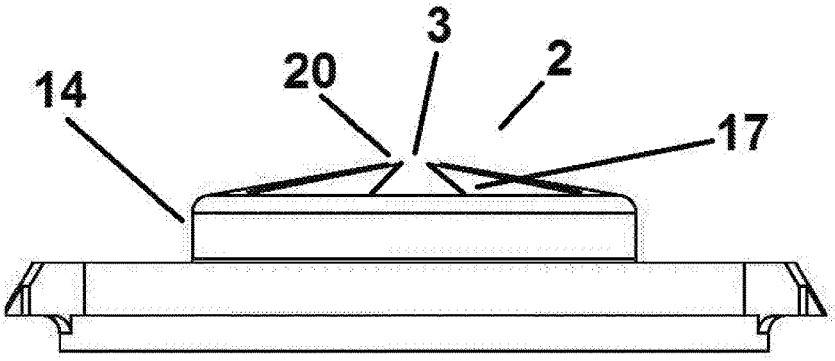

Referring to FIG. 5*a*, there is shown a downward side view of the head of a dispensing nozzle 2 prior to insertion of a wipe. The spikes 17 are in their first position, that of being generally pointing towards the centre of the aperture but also inclined at an angle in the direction of the wipe as it is withdrawn from the housing container. This small upward angularity is more clearly shown in FIG. 5*b* and FIG. 5*c*.

Figure 5C:
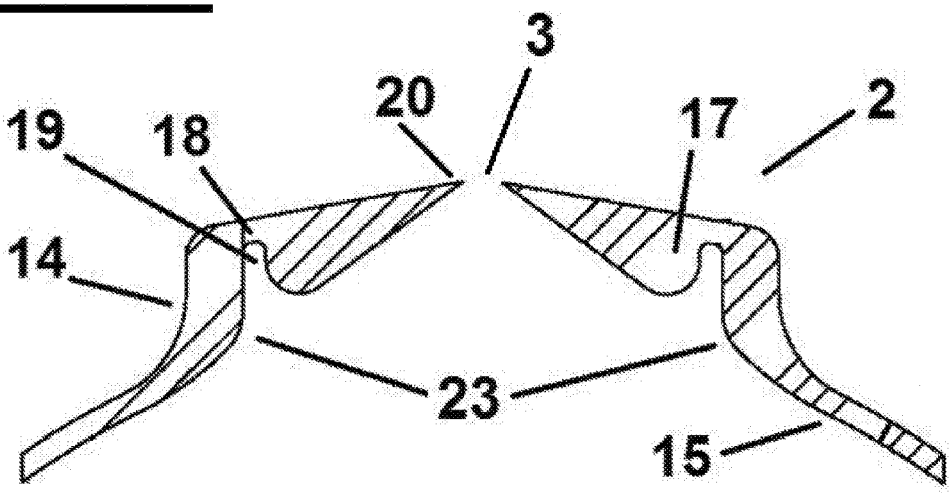

This slight upward curve in the shape of the spikes could help make feeding of the first wipe a little easier and as can be seen a little more clearly in FIG. 5*c*, it enables the underside of the spikes to more easily form a funnel shape to help with the passage of the wipes through the annular projection.

Referring to FIG. 5*c* there is shown spikes 17 in their first position slightly inclined in the direction of the passage of the wipe out though the container. The spikes feature slits 19 that form the axes 18 about which the spikes 17 can flex upwards to their second position when upward pressures are applied to the ends of the spikes 20. So as a wipe passes though the annular projection 14, the spikes flex upwards about their axes 18 to their second position, wherein the spikes are at a greater angle in the direction to the passage of a wipe out of the container.

Greater force would however be required to move the spikes 17 downwards from their first position to their third position, wherein the spikes are generally at an angle inclined in the direction opposite to the passage of a wipe as it is withdrawn from the housing container.

This is because as downward forces are applied to the spikes, their bases abut the inside wall of the annular projection 14 which therefore impedes downward movement of the spike. The 'points of weakness' axes 18, coupled with the wider base of the spikes abutting the inside of the annular projection 14 therefore enables the spikes to act like a one-way valve. The larger the surface area of the base of the spike the deeper the slit can be and ipso facto the greater the surface area that the lower base of the slit 24 can abut the inside wall of the annular projection or the stump 25 of the spike as shown in FIG. 5*e*.

Having the spikes featuring their slit line of weakness deployed on the inside wall of an annular projection enables the spikes to feature larger bases and the more robust the structure of the spikes, the more efficaciously they can resist pressures to force them into their third position.

So incorporating an annular projection into their structure enables the manufacturer to build dispensing nozzles that are can both prevent wipe fall back for both light and heavy substrates and make them less likely to permit the user or curious small children to injure themselves by pushing their fingers back through the opening 3 of the nozzles and entrapping them.

The point 23 at which the dome 15 curves smoothly upwards into the annular projection 14 is shown to be of graceful curved shaping in order to minimize the impact it has on the exiting wipe and thereby reduce the chances for premature rupturing of the perforation line.

Figure 5D:
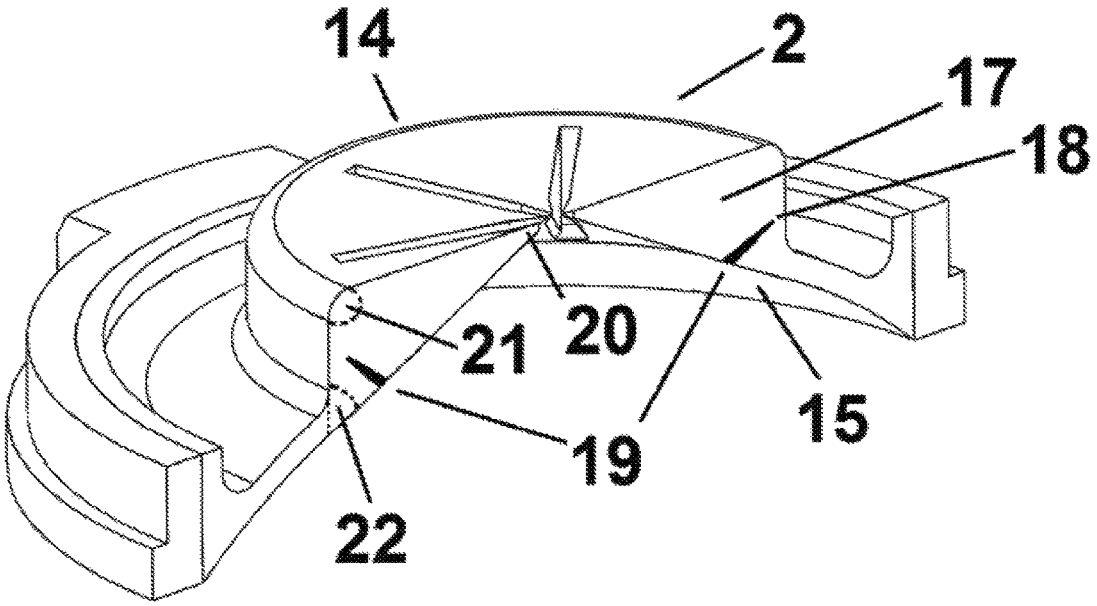
Figure 5E:
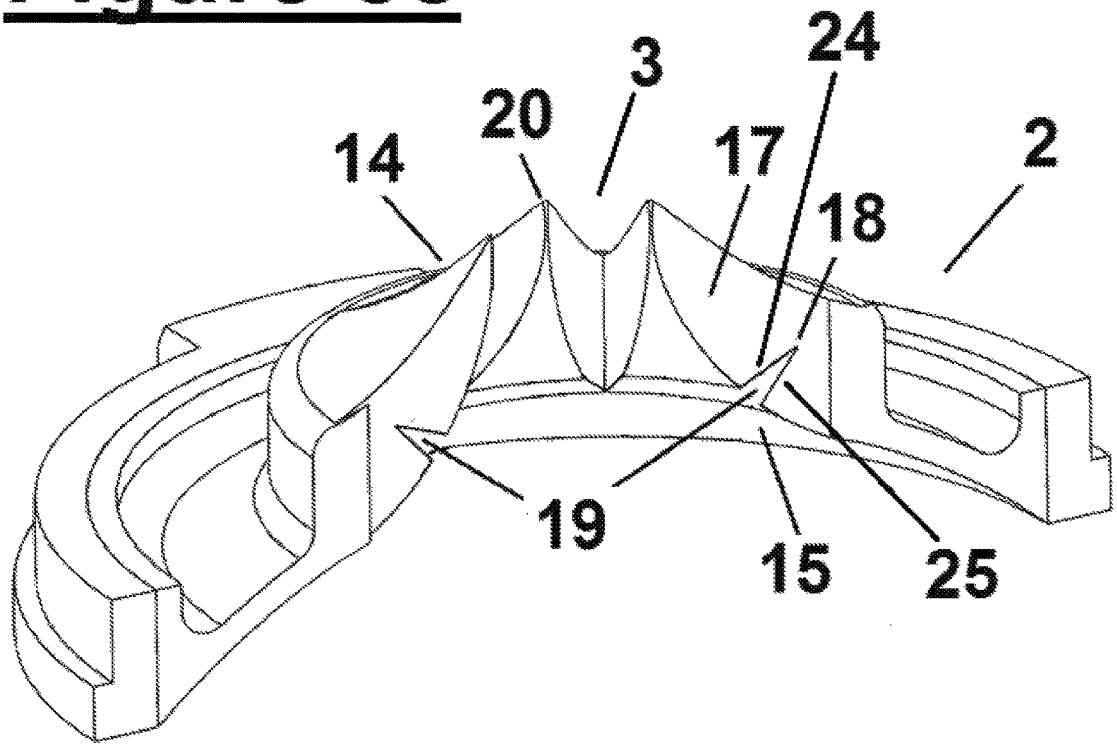
Figure 5F:
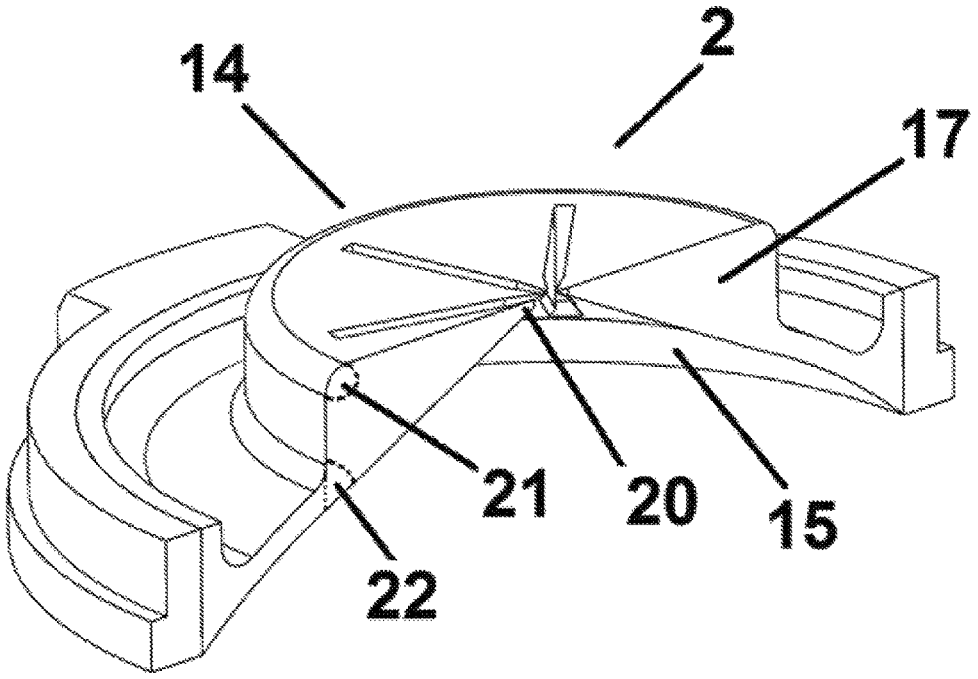
Figure 5G:
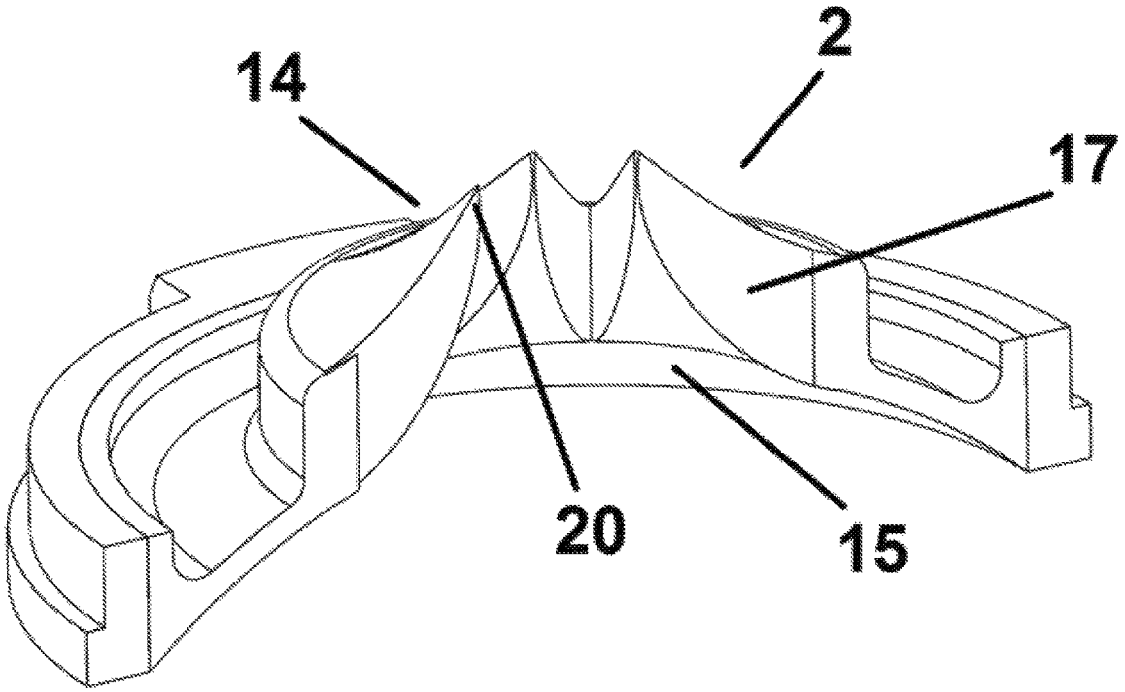

Referring to FIG. 5*d*, there is shown a cross section view of nozzle 2 featuring slits 19 that form axes 18. The spikes 17 are in their first position, that of generally pointing towards the centre of the annular projection.

The angle 21 is greater than the acute angle 22, angle 21 preferably being greater than 90 degrees. This shaping therefore makes it even more difficult for pressure to move the spikes into their third position Referring to FIG. 5*e*, because of the nature of the spikes and the annular projection, which could be comprised of an elastomeric or a less flexible material like polypropylene, upward pressure applied to the end of the spike 20 as a wipe (not shown) is inserted into the nozzle 2 causes the slits 19 to agape and for the spikes 17 to therefore flex about their axes and point in the general direction of the passage of the wipe through the annular projection, their second position. The walls of the annular projection 14 then allow passage of the wipe through its structure.

Downward pressures applied to the agape spikes in their second position force the spikes back towards their first position causing the agape base of the spike 24 to abut the stump 25 of the spike thereby deterring the spike to flex to its third position, giving this dispensing nozzle iteration its one-way valve properties.

The spikes 17 are deployed on the inside of the annular projection 14. The wider the annular projection 14, the greater the surface area the base of the spike 17 can be and therefore the deeper the slit 19 can be. Ipso facto the wider surface of the agape base of the spike 24 that can abut the stump 25. This increased surface area contact between the base 24 and the stump 25 increases the level of resistance the spikes can provide to forces acting in the opposite direction to direction of the wipe exiting the container.

The architecture of the nozzles 2 featured in FIG. 5 enables the dispensing nozzle units to be adapted to various wipe types by altering the variables within their structure.

- By increasing the width of the annular projection 14, wipes of different widths and thickness can be accommodated.
- Increasing the surface area of the base of the spikes 17 deployed on the inside of the annular projection increases the resistance of the spikes to downward pressures.
- By increasing the length of the spikes 17, the resistance that the spikes apply to the exiting wipe can be increased.
- By shortening the length of the spikes 17, less pressure can be applied to exiting wipe and wipes can be more easily fed through the opening 3.
- By making the spikes 17 from a more flexible material the resistance that the spikes apply to the exiting wipe can be increased.
- By increasing the width of the axis 18, its depth of flex, more resistance can be applied to the exiting wipe and visa versa.

It is therefore implicit that there is an inverse relationship for a given aperture width between the length of the spikes and the depth of flex/resistance level at the area of weakness. This relationship can be used in order for manufacturers to establish the desired level of 'ease of feed' that they want to offer their customers without compromising the level of resistance to the exiting wipe required in order to bring about wipe separation. For a given diameter of annular projection, the spike length can be reduced to make the opening 3 wider, opening 3 being defined by the distance between the tips of the spikes 20 when in their first positions. The depth of flex can then be increased in order to restore the level of resistance applied by the spikes to the wipes in order to bring about their separation. So for a given level of pressure required to separate the wipes, the greater the level of resistance provided at the area of weakness, the shorter the spikes 17, (and therefore the wider the opening 3), can be prior to insertion of the wipe.

So having a specific line/section of weakness about which the spikes flex confers many advantages including:

1) Enabling easier design of dispensing nozzles because variables like the depth of flex, the length of the spike etc very specific variables that can be adjusted and yield predicable results. If the flexibility of the spikes were reliant solely on the tapered design of the underside of the spike, as is disclosed in US 2010/0133287 A1, lines 9-12, the rate at which the spike tapers and how each change effects the way the spike arc flexes would also need to be considered which would make finding the correct 'length of spike/resistance to flex' ratio a more complicated process.

2) Enabling the spikes to be of a more rigid strength throughout their structure. This design of spike might particularly suit wipes made from heavier substrate types because the spikes can therefore be of a more robust strength. Spikes that are reliant on a tapering shape for their flexibility as is disclosed in US 2010/0133287 A1 might buckle at thinner parts of their structure when subjected to downward forces from heavier substrate types.

3) Enabling the easier choice as to the degree to which the spikes should flex to their second position. Again, by altering a single variable, e.g. the depth of the line of flex, the spikes will flex more or less as required as the wipe passes through the aperture. The greater the angle of flex, the greater the degree to which forces from the underside of the spikes will play in separating the wipes, and the less the wipe separation process will be due to penetration of the web by the sharp ends of the spikes. By playing a much reduced part in the wipe separation process, these sharp ends therefore have much reduced opportunity to damage the fabric of the wipe as it passes over them. This may be more appropriate for delicate substrates that could be damaged due to the impact of sharp spikes as the web passes over them on its way out of the container.

The acute angle of the lower side of spikes 17 as shown in FIGS. 4 & 5 confers two important benefits.

1) As can be seen particularly in FIGS. 5*c* and 5*d*, the lower sides of the spikes 17 are at an acute angle, angle 22. This means that the lower sections of the spikes 17 form a sort of funnel. As a wipe (not shown) passes through the annular projection 14, the funnel shaping created by the acute angled underside of the spikes encourages the exiting wipe material to fill the now wider, triangular gaps between the spikes on its passage out through the annular projection. After the exiting wipe separates from the web, the tail of the emerging wipe, which now occupies the triangular shaped gaps between the spikes, slips back a little thereby helping to settle the wipe material into the open, triangular shaped gaps between the spikes. This ipso facto helps seal the container which thereby deters wipe dry out.

2) Because the spikes flex upwards, the gaps between the spikes open up and the wipe material spreads itself into these gaps. Therefore ipso facto a greater surface area of the exiting web and its perforation line come into close contact with the ends of the spikes 20. This therefore enables the ends of the spikes 20 to more effectively penetrate and bring about rupturing of the perforation line which thereby encourages wipe separation.

If the spikes 17 were less flexible and not shaped with an acute angle 22 to the lower surface, the web would not be encouraged to fill the gaps between the spikes 17, instead the wipes would be inclined to exit the container in a more compact, cylindrical format. The perforation lines would thereby be much less exposed to the ends of the spike 20, which then lessens their ability to penetrate and rupture the perforation line to bring about wipe separation.

Prior Art disclosures such as US 2015/048105 A1 (Michael John Gordon GB) 19 Feb. 2015 and US 2010/133287 A1 (Tramontina Paul Francis US) do not mention or intimate the presence of slits or other points of weakness to enable the spikes to flex in the direction of the passage of a wipe through the structures of their dispensing nozzles or that the shape of the spikes or flaps feature a lower section with an acute angle, angle 22, that enables the spikes to form a sort of funnel shape, as shown in FIG. 5.

In all of FIGS. 4 & 5, the annular projection 14 with protuberances 16 and spikes 17 on its inside wall and the dome like structure 15 to which the annular projection 14 is firmly attached could both be made from the same material or from a mixture of materials. The annular projection 14 with protuberances 16 and spikes 17 could be made from a flexible elastomer, and the dome like structure 15 to which the annular projection 14 is firmly connected could be both made from a more rigid material like polypropylene or HDPE. Alternatively the various components of the dispensing nozzle 2 could be made from a single flexible or single more rigid material or the dispensing nozzle could be comprised of components made from a variety of flexible and more rigid materials built into the same dispensing nozzle structure.

Throughout this disclosure, whenever the spikes are in their first position, the spikes based valve-like structure helps seal the pack in order to keep the wipes within the container moist.

Throughout this disclosure, whenever the spikes feature points of weakness solely to the underside of the base of the spikes, this forms a one-way valve-like structure which makes it harder to force the spikes from their first position to their third position than it takes to force the them to their second position. Ipso facto this structure helps prevent fingers from being pushed into the container while at the same time making a further contribution to preventing wipe fall back into the container.

Additionally the manufacturer of the wipes can vary the strength of the perforations in order to ensure that the wipes dispense successfully through a nozzle type of a specific architecture.

The pointed, tapering nature of the spikes shown here-in means that they offer less resistance at the centre of the aperture and are easier to flex when pressure is applied at that point. There is therefore less need for the opening 3 to be wide enough to thread the first wipe through it. Instead the first wipe can be fed through the aperture by applying pressure to the end of the wipe with the thumb or finger and then pushing said wipe through this weaker centre section of the valve-like formation of the flexible spikes. This can be an easier way to feed a wipe through the nozzle particularly if the aperture features an annular projection with a maze of fixed pips, projections or raised regions deployed on its which may make a threading process more difficult.

Further modifications will be apparent to those skilled in the art without departing from the scope of the present invention.

The invention claimed is:

1. A dispensing container for wipes with a dispensing nozzle comprising:

a housing which in use receives wipes, said wipes being formed of sheets the ends of said wipes being releasably attached to each other in a series which are capable of being detached into separate wipes when subject to a separation force, the dispensing container has a resilient dispensing nozzle which has an annular projection featuring an aperture at its tip, in use a wipe can be withdrawn from the dispensing container through the aperture of the nozzle, the nozzle exerting sufficient gripping force on the wipe so as to enable or promote the separation of one wipe from its adjacent wipe, one or more spikes or projections are deployed within the dispensing nozzle having their base on the inner surface of the annular projection, one or more spikes or projections being able to flex between a first position, that of the one or more spikes or projections being generally pointing towards the center of the aperture and a second position, that of the one or more spikes or projections being generally at an angle of greater inclination in the direction to the passage of the wipe as it is withdrawn from the dispensing container through the aperture of the nozzle, the shape of the spikes or projections being such that as they flex to their second position during normal use the wipe material can occupy all gaps within the dispensing nozzle through which the wipes can exit the dispensing container, its bending moment being such that it requires less force to flex the one or more spikes or projections from their first position to their second position than it takes to flex the one or more spikes or projections from their first position to their third position wherein the ends of the one or more spikes or projections are generally at an angle inclined in the direction opposite to the passage of the wipe as it is withdrawn from the dispensing container, the difference in bending moment of one or more spikes or projections is caused by at least the shape/angularity of the spikes or projections which when considered in radial cross section feature an angle between the annular projection and the top surface of the spike or projection which is greater than the angle between the annular projection and the lower surface of the spike or projection.

2. A dispensing container for wipes according to claim 1 wherein the wipes are releasably attached to each other by the adhesion or cohesion of a viscous substance, a line of perforations, frictional forces arising from being interleaved, or any combination of the aforementioned.

3. A dispensing container for wipes according to claim 1 wherein the ends of one or more spikes being generally of a non arcuate, narrow pointed shape.

4. A dispensing container for wipes according to claim 1 wherein the underside of the spikes form a funnel shaped structure.

5. A dispensing container for wipes according to claim 1 wherein the nozzle features a combination of ribs, pips, spikes, projections, raised or roughened region or other gripping means together.

6. A dispensing container for wipes according to claim 1 wherein the aperture is formed from a flexible elastomeric material and is expandable being biased towards a contracted state as the wipe is extracted.

7. A dispensing container for wipes according to claim 1 wherein the dispensing nozzle is made from a single material in a single shot injection moulding process.

8. A dispensing container for wipes according to claim 1 wherein the spikes are formed from a plastic material like polypropylene or HDPE.

9. A dispensing container for wipes according to claim 1 wherein the walls of the nozzle taper inwards from a widened base and then curve outwards into an annular projection which features an aperture at its tip.

10. A dispensing container for wipes according to claim 9 wherein the widened base is dome shaped.

11. A dispensing container for wipes according to claim 1 wherein the difference in bending moment of one or more spikes is at least because they feature areas of weakness about which the spikes flex from their first to their second positions.

12. A dispensing container for wipes according to claim 11 wherein the area of weakness that causes the difference in bending moment of the one of more spikes or projections is due to the presence of a slit in the structure of the one or more spikes or projections, which enables the one or more spikes or projections featuring the slits to flex to their second position.

13. A dispensing container for wipes with a dispensing nozzle comprising:

a housing which in use receives wipes, said wipes being formed of sheets the ends of said wipes being releasably attached to each other in a series which are capable of being detached into separate wipes when subject to a separation force, the dispensing container has a dispensing nozzle with an aperture at its tip, in use a wipe can be withdrawn from the dispensing container through the aperture of the nozzle, the nozzle exerting a gripping force of sufficient magnitude on the wipe so as to enable or promote the separation of one wipe from its adjacent wipe, one or more spikes are deployed within the dispensing nozzle, the spikes featuring a wider section at a point closer to its base that then tapers to a narrower apex, the one or more spikes being able to flex between a first position, that of one or more spikes being generally pointing towards the center of the aperture and a second position, that of the one or more spikes being at an angle of greater inclination in the direction to the passage of the wipe as it is withdrawn from the dispensing container through the aperture of the dispensing nozzle, the bending moment of the one or more spikes is such that it requires less force to flex the one or more spikes from their first position to their second position than it takes to flex the one or more spikes from their first position to their third position wherein the ends of the one or more spikes are generally at an angle inclined in the direction opposite to the passage of the wipe as it is withdrawn from the aperture of the dispensing container, the difference in bending moment of one or more spikes is at least because they feature areas of weakness about which the spikes flex from their first to their second positions.

14. A dispensing container for wipes according to claim 13 wherein the shape of the spikes or projections is such that as they flex to their second position during normal use the wipe material can occupy all of the exit gaps of the dispensing nozzle.

15. A dispensing container for wipes according to claim 13 wherein the wipes are releasably attached to each other by the adhesion or cohesion of a viscous substance, a line of perforations, frictional forces arising from being interleaved, or any combination of the aforementioned.

16. A dispensing container for wipes according to claim 13 wherein the spikes are formed from a plastic material like polypropylene or HDPE.

17. A dispensing container for wipes according to claim 13 wherein the dispensing nozzle is made from a single material in a single shot injection moulding process.

18. A dispensing container for wipes according to claim 13 wherein the aperture, being formed from a flexible elastomeric material, is resilient and expandable being biased towards a contracted state as the wipe is extracted.

19. A dispensing container for wipes according to claim 13 wherein the nozzle features a combination of ribs, pips, spikes, projections, raised or roughened region or other gripping means together.

20. A dispensing container for wipes according to claim 13 wherein the underside of the spikes form a funnel shaped structure.

21. A dispensing container for wipes according to claim 13 wherein the ends of one or more spikes being generally of a non arcuate, narrow pointed shape.

22. A dispensing container for wipes according to claim 13 wherein the area of weakness that causes the difference in bending moment of the one of more spikes or projections is due to the presence of a slit in the structure of the one or more spikes or projections, which enables the one or more spikes or projections featuring the slits to flex to their second position.

23. A dispensing container for wipes according to claim 13 wherein the difference in bending moment of one or more spikes or projections is caused by at least the shape/angularity of the spikes or projections which when considered in radial cross section feature an angle between the annular projection and the top surface of the spike or annular projection which is greater than the angle between the annular projection and the lower surface of the spike or projection.

24. A dispensing container for wipes according to claim 13 wherein the walls of the nozzle taper inwards from a widened base and then curve outwards into an annular projection which features an aperture at its tip.

25. A dispensing container for wipes according to claim 24 wherein the widened base is dome shaped.

26. A dispensing container for wipes according to claim 24 wherein the one or more spikes or projections deployed within the dispensing nozzle has its base on the inner surface of the annular projection.

* * * * *